US006319063B1

(12) United States Patent
Huang

(10) Patent No.: US 6,319,063 B1
(45) Date of Patent: Nov. 20, 2001

(54) SHIELDED ELECTRICAL CONNECTOR

(75) Inventor: Nan-Tsung Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/653,921

(22) Filed: Sep. 1, 2000

(30) Foreign Application Priority Data

May 16, 2000 (TW) ..... 089208223

(51) Int. Cl.[7] ..... H01R 13/648; H01R 9/03
(52) U.S. Cl. ..... 439/610; 439/607; 439/609
(58) Field of Search ..... 439/610, 609, 439/607

(56) References Cited

U.S. PATENT DOCUMENTS 5,147,220 * 9/1992 Lybrand ..... 439/567
5,685,739 * 11/1997 Davis et al. ..... 439/607
5,779,489 * 7/1998 Davis et al. ..... 439/79
6,139,367 * 10/2000 Yeh ..... 439/609

* cited by examiner

*Primary Examiner*—Paula Bradley
*Assistant Examiner*—Ann McCamey
(74) *Attorney, Agent, or Firm*—Wei Te Chung

(57) ABSTRACT

A shielded electrical connector (1) comprises an insulative housing (10) having a mating portion (11) defining passageways (111) therein, a plurality of terminals (20) received in corresponding passageways, and a shield (50) enclosing the housing. A rectangular receiving opening (521) is defined in a front surface (52) of the shield for exposing the mating portion of the housing to a complementary plug connector. The rectangular receiving opening is defined by a pair of opposite lateral edges (56, 58) and a pair of longitudinal edges (57, 59). A pair of spring fingers (524, 524') respectively extends rearward from the lateral edges in a staggered manner. A sum of lengths of the spring fingers is substantially larger than the length of each longitudinal edge whereby the complementary plug connector is reliably retained in a mated position.

1 Claim, 4 Drawing Sheets

SHIELDED ELECTRICAL CONNECTOR

BACKGROUND OF THE INVENTION

1. Field of the Invention

The present invention relates to a shielded electrical connector, and particularly to a shielded USB (Universal Serial Bus) connector having spring fingers provided on a shield thereof for ensuring a reliable engagement between the USB connector and a complementary plug connector.

2. Description of Prior Art

USB connectors are increasingly used in the electrical connector field and are intended to integrate most different types of I/O connectors, such as D-Sub connectors and Mini-Dins, into a standard form. A shield is often used to enclose the USB connector housing for protection against electromagnetic interference. To ensure a reliable engagement between the USB connector and a complementary plug connector, a plurality of spring fingers are integrally stamped from peripheral surfaces of the shield of the USB connector for engaging with the complementary plug connector, thereby retaining the complementary plug connector in a mated position. Such a design is disclosed in U.S. Pat. Nos. 5,738,544; 5,779,489 and 5,928,035. The disadvantage of this design is that repeated stamping processes are required, thereby complicating manufacturing. In addition, the shielding performance is also degraded.

Another relatively simple approach for retaining a complementary plug connector in position is to provide a pair of opposite, rearwardly extending spring fingers at opposite lateral edges of a rectangular opening of a shield adapted to receive the complementary plug connector. Relevant designs are disclosed in U.S. Pat. Nos. 5,083,945; 5,207,597 and 5,378,172. However, since the pair of spring fingers is stamped from the shield and is typically arranged symmetrically, the sum of the lengths of the spring fingers is limited to the length of a longitudinal edge by the rectangular opening. Accordingly, the retention force of the spring fingers may be insufficient to reliably retain the complementary plug connector in position.

Therefore, it is desirable to have a shield with a pair of spring fingers each having sufficient length to reliably retain a complementary plug connector in position.

SUMMARY OF THE INVENTION

Accordingly, one object of the present invention is to provide a USB connector having a shield that has a pair of spring fingers each having sufficient length to ensure a reliable engagement between the USB connector and a complementary plug connector.

Another object of the present invention is to provide a USB connector having a shield that provides complete shielding.

A further object of the present invention is to provide a USB connector having a shield with a simple structure for simplifying manufacturing.

In order to achieve the objects set forth, a shielded electrical connector of the present invention comprises an insulative housing having a mating portion with a plurality of passageways defined therein, a plurality of terminals received in corresponding passageways, and a shield enclosing the housing for electromagnetic interference protection. A rectangular receiving opening is defined in a front surface of the shield for exposing the mating portion of the housing to a complementary plug connector. The rectangular receiving opening is defined by a pair of opposite lateral edges and a pair of longitudinal edges. A pair of spring fingers respectively extends rearward from the lateral edges in a staggered manner. Each spring finger has a length substantially equal to the length of each longitudinal edge whereby the complementary plug connector is reliably retained in a mated position.

Other objects, advantages and novel features of the invention will become more apparent from the following detailed description when taken in conjunction with the accompanying drawings.

DETAILED DESCRIPTION OF THE INVENTION

Figure 1:
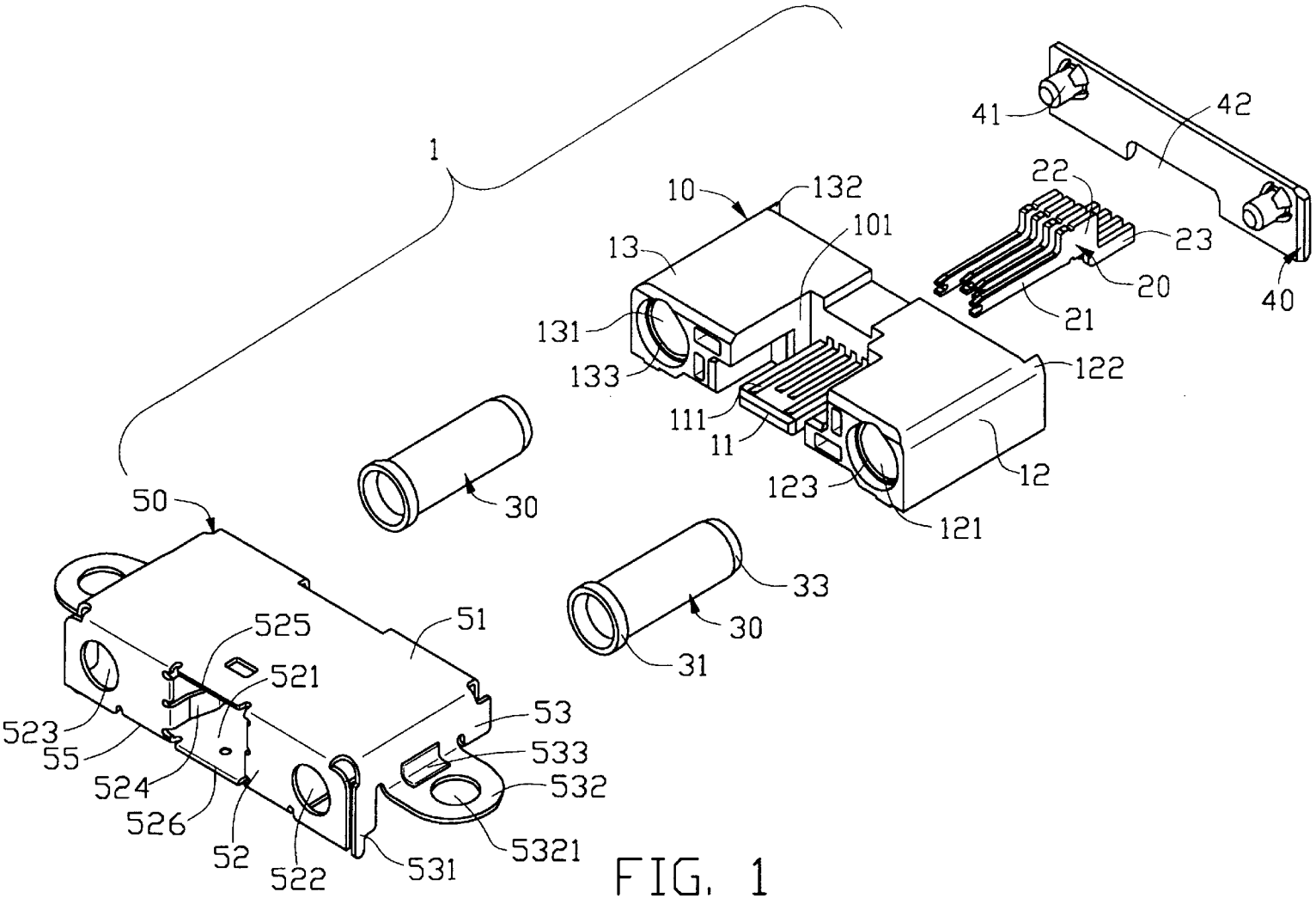
FIG. 1 is an exploded perspective view of a USB connector of the present invention.

Reference will now be made to the drawing figures to describe the present invention in detail.

Referring to FIG. 1, a USB connector 1 of the present invention comprises an insulative housing 10, a plurality of terminals 20 for being received in the housing 10, a pair of bushings 30 for being retained in the housing 10, a positioning panel 40 for being attached to a rear side of the housing 10, and a shield 50 for enclosing the housing 10.

The housing 10 defines a cutout 101 in a middle portion thereof with a forwardly extending mating portion 11 received therein for mating with a complementary plug connector (not shown). A plurality of passageways 111 is defined in the mating portion 11 for receiving the terminals 20 therein. A pair of side portions 12 and 13 of similar structure is provided on opposite sides of the cutout 101 each with a channel 121, 131 respectively defined therein for receiving the bushing 30. Each channel 121, 131 has a front enlarged portion 123, 133. A pair of ribs 122 and 132 is respectively formed on the rear ends of the side portions 12 and 13 and is spaced a distance substantially equal to the length of the positioning panel 40 for retaining the positioning panel 40 therebetween.

Each terminal 20 comprises a front contact portion 21 for mating with a corresponding terminal (not shown) of the complementary plug connector, a middle retention portion 22 for retaining the contact 20 in the housing 10, and a rear solder tail 23 extending rearward from the housing 10 for being surface mounted to a printed circuit board (not shown) on which the connector 1 is mounted.

The bushing 30 has a front large-dimensioned end portion 31 and a rear small-dimensioned end portion 33. The front large-dimensioned end portion 31 is adapted to engage with a corresponding front enlarged portion 123, 133 of the channel 121, 131 in the housing 10 thereby securely retaining the bushing 30 in the housing 10.

The positioning panel 40 is adapted to be positioned between the ribs 122 and 132 of the housing 10 and forms a post 41 adjacent to each end thereof for being retained in the rear small-dimensioned end portion 33 of a corresponding bushing 30. A recess 42 is defined in a bottom edge of the positioning panel 40 for extension of the rear solder tails 23 of the terminals 20.

Figure 2:
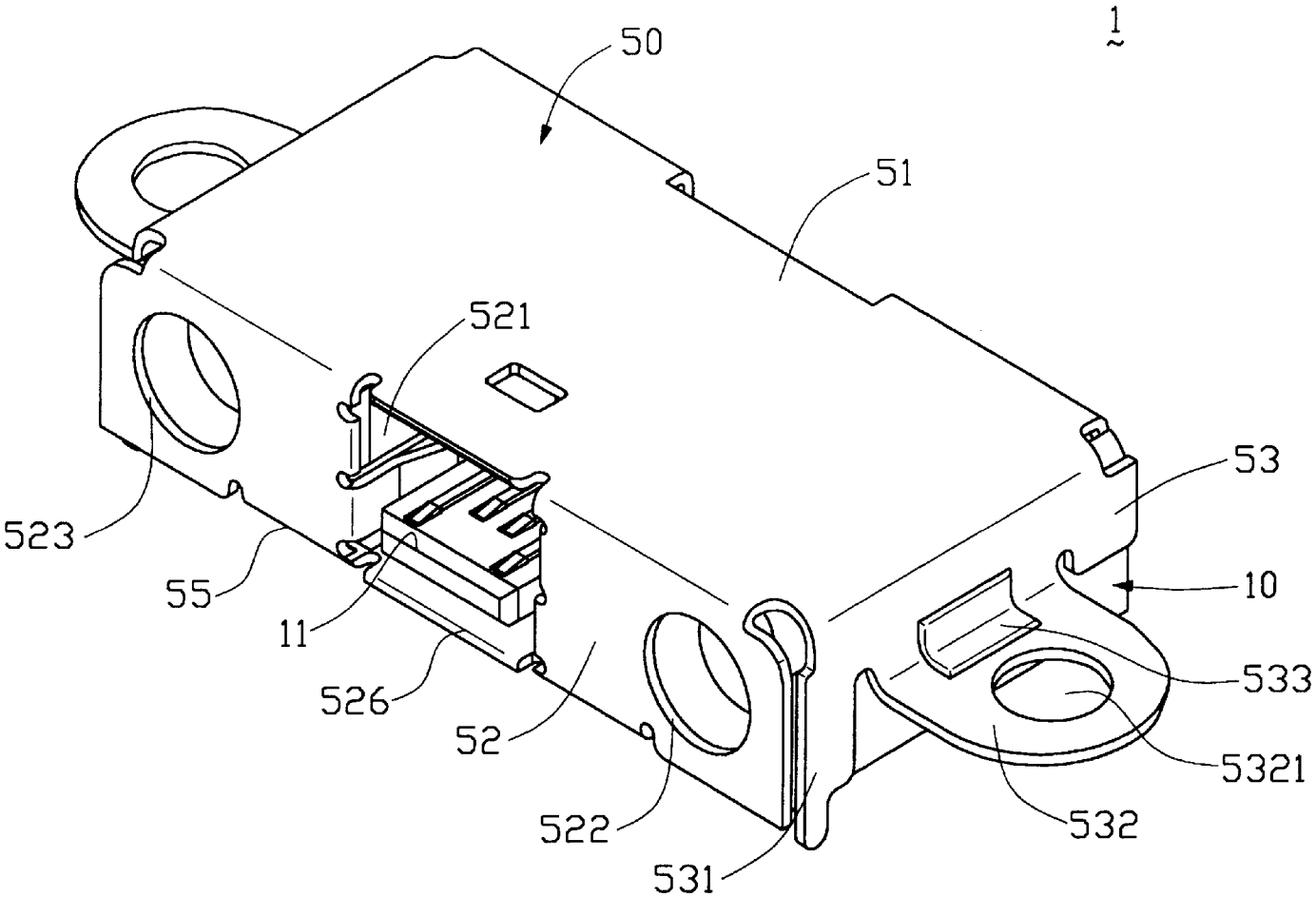
FIG. 2 is an assembled view of FIG. 1.
Figure 3:
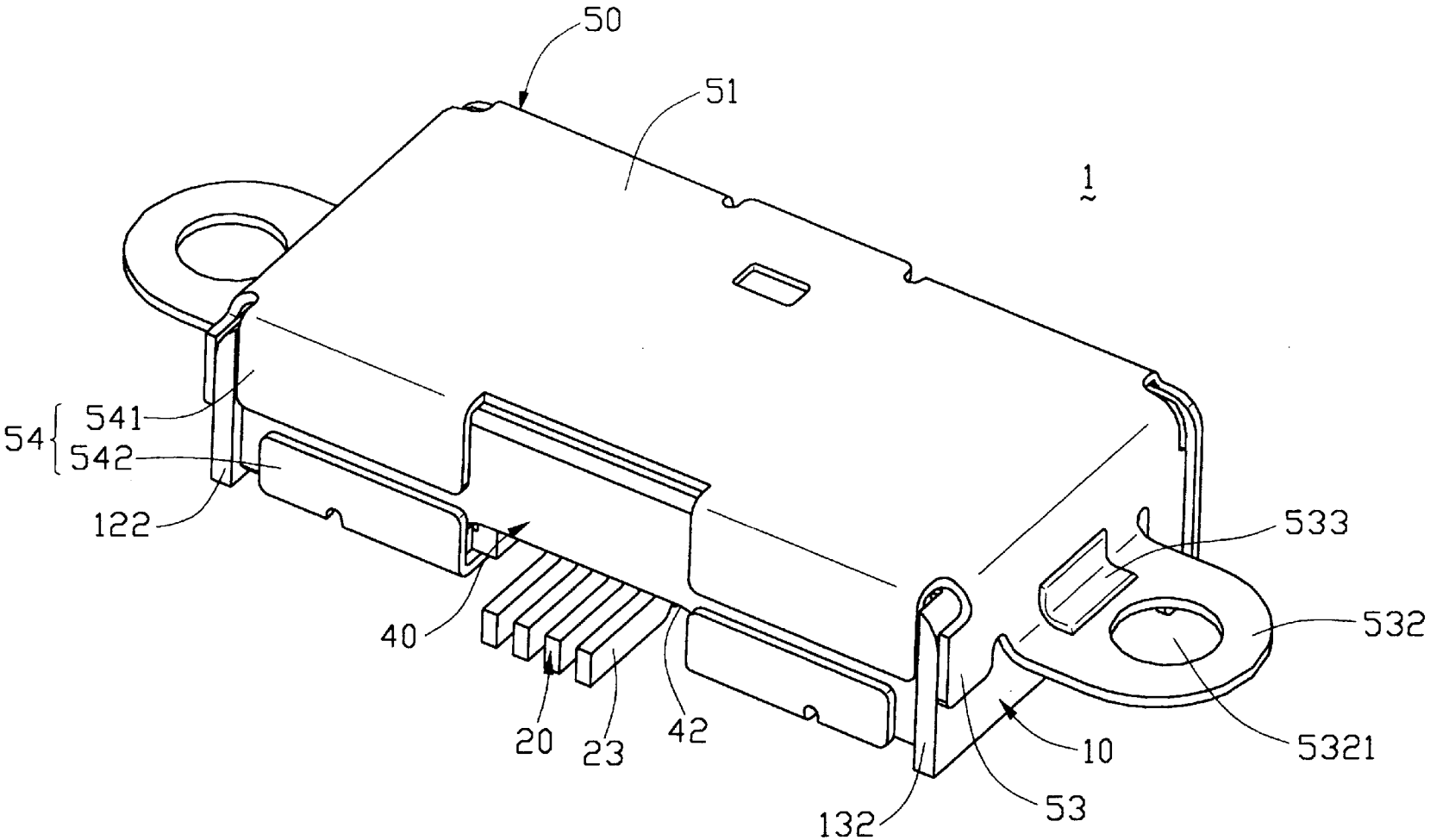
FIG. 3 is a rear perspective view of FIG. 2.

Also referring to FIGS. 2 and 3, the shield 50 is stamped from a metal sheet and comprises a top surface 51, a front surface 52, a pair of side surfaces 53, a rear surface 54, and a bottom surface 55 whereby a complete shielding of the housing 1 can be achieved.

Each side surface 53 provides a downwardly extending positioning member 531 for being inserted into a corresponding hole of the printed circuit board, and a horizontally bent trunnion 532 with a hole 5321 defined therein for receiving a securing means. The positioning member 531 and the trunnion 532 are adapted to cooperatively mount the assembled connector 1 on the printed circuit board. A reinforcing member 533 is provided at a bend line of the trunnion 532 for enhancing the strength thereof.

As is clearly shown in FIG. 3, the rear surface 54 of the shield 5 is composed of a pair of first tags 541 downwardly extending from the top surface 51 and a pair of second tags 542 upwardly extending from the bottom surface 55. Each first tag 541 has an outer lateral edge for abutting against an inner surface of a corresponding rib 122, 132 of the housing 10, and each second tag 542 is spaced from the corresponding rib 122, 132. The first and second tags 541 and 542 are adapted to cooperatively further retain the positioning panel 40 in position relative to the housing 10 whereby rearward displacement of the terminals 20 is prevented thereby facilitating soldering process of the solder tails 23.

Also referring to FIG. 2, the front surface 52 of the shield 50 defines a pair of receiving holes 522 and 523 in alignment with the respective channels 121 and 131 of the housing 10 for extension of an auxiliary latching means of the complementary plug connector. A rectangular receiving opening 521 is defined in the front surface 52 for exposing the mating portion 11 of the housing 10 to the complementary plug connector.

Figure 4:
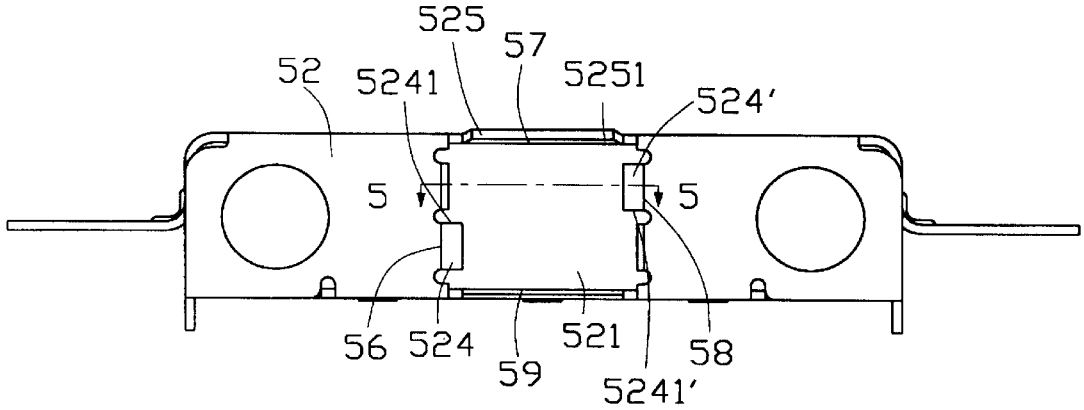
FIG. 4 is a front view of a shield of the USB connector shown in FIG. 1.
Figure 5:
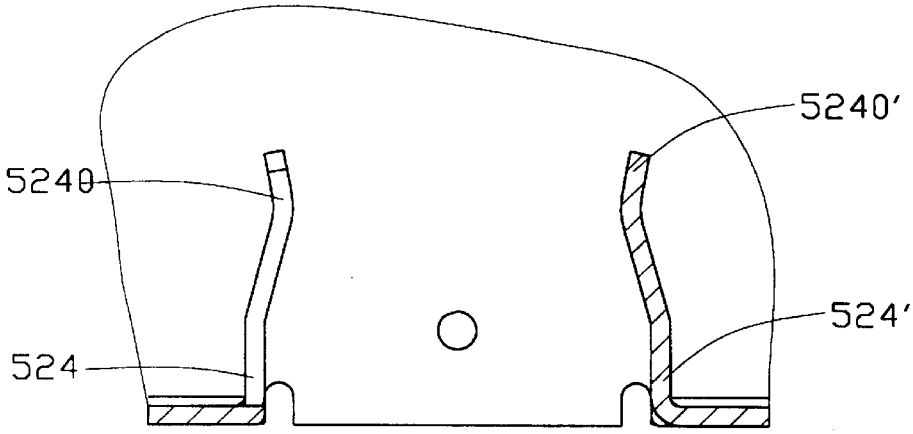
FIG. 5 is a cross-sectional view taken along line 5—5 of FIG. 4.

As is clearly shown in FIGS. 4 and 5, the rectangular receiving opening 521 is defined by a pair of opposite lateral edges 56 and 58 and a pair of opposite longitudinal edges 57 and 59. A pair of leading tongues 525, 526 respectively extends forward from the longitudinal edges 57 and 59 each having an inclined surface 5251 for facilitating insertion of the complementary plug connector. To retain the inserted complementary plug connector in a mated position, a pair of spring fingers 524 and 524' is integrally stamped from the shield 50 and respectively extends rearward from the lateral edges 56 and 58. Specifically, the spring fingers 524 and 524' are arranged in a staggered manner and have curved free ends 5240 and 5240' extending toward each other. The spring finger 524 is located at a level different from the spring finger 524' and a bottom edge 5241' of the spring finger 524' is substantially higher than a top edge 5241 of the spring finger 524. As is known to one having ordinally skill in the pertinent art, the bottom edge 5241' may be substantially flush with the top edge 5241, if desired.

By such a design, a sufficient length of each spring finger 524, 524', is substantially larger than of each longitudinal edge 57, 59, thereby achieving a sufficient length of each spring finger 524, 524' and ensuring a reliable engagement between the USB connector 1 and the complementary plug connector. In other words, due to the provision of the staggered spring fingers 524 and 524', the complementary plug connector is reliably retained in the USB connector 1 in a very simple but effective way without any modification to the remaining parts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shielded electrical connector for connecting with a complementary connector, comprising:

an insulative housing having a mating portion with a plurality of passageways defined therein, a cutout defined in a middle portion thereof and a pair of side portions on opposite sides of the cutout, each with a channel defined therethrough, the mating portion being received within the cutout;

a plurality of terminals received in corresponding passageways of the mating portion;

a shield enclosing the housing, the shield having at least a front surface, a top surface and a pair of side surfaces, each side surface comprising a downwardly extending positioning member and a horizontally bent trunnion for securely mounting the shielded connector to a printed circuit board, the front surface defining a rectangular receiving opening therein for exposing a mating portion of the housing to a complementary connector, the rectangular receiving opening being defined by a pair of opposite lateral edges and a pair of opposite longitudinal edges, a pair of receiving holes, a pair of spring fingers having curved free ends respectively extending rearward from the lateral edges, the pair of spring fingers arranged in a staggered manner, a sum of lengths of the spring fingers being larger than the length of each longitudinal edge for ensuring a reliable engagement between the complementary connector and the mating portion of the housing;

a pair of bushings received in corresponding channels of the housing and through the receiving holes of the shield;

and a positioning panel assembled to a rear side of the housing, the positioning panel forming a post adjacent to each end thereof for engaging with the corresponding bushing.

* * * * *